US005109208A

United States Patent [19]

Murison

[11] Patent Number: 5,109,208

[45] Date of Patent: Apr. 28, 1992

[54] CURRENT LIMITING ELECTRICAL REACTOR

[75] Inventor: George E. Murison, Omemee, Canada

[73] Assignee: General Electric Canada Inc., Mississauga, Canada

[21] Appl. No.: 658,264

[22] Filed: Feb. 20, 1991

[30] Foreign Application Priority Data

Aug. 30, 1990 [CA] Canada ..... 2024289

[51] Int. Cl.[5] ..... H01F 27/08; H01F 27/30

[52] U.S. Cl. ..... 336/62; 336/65; 336/192; 336/208; 336/223

[58] Field of Search ..... 336/198, 197, 208, 232, 336/223, 65, 62, 192, 67

[56] References Cited

U.S. PATENT DOCUMENTS 1,781,776 11/1930 Capps ..... 336/223
1,905,216 4/1933 Capps ..... 336/223
2,999,990 9/1961 Zadk ..... 336/223

FOREIGN PATENT DOCUMENTS 1049007 1/1959 Fed. Rep. of Germany ..... 336/62
2607883 2/1976 Fed. Rep. of Germany ..... 336/62

*Primary Examiner*—Thomas J. Kozma

[57] ABSTRACT

There is disclosed a current limiting electrical reactor that efficiently uses space. The reactor includes a supporting core with a circular periphery where the conductor is wound about the periphery of the coil in a convoluted spiral that spirals laterally out from the periphery of the core over itself, and lies in a radial plane passing through the core. A first terminal, adapted for electrical connection, is positioned at the beginning of the innermost turn of the conductor. A second terminal, also adapted for electrical connection, is positioned at the end of the outermost turn of the electrical conductor. Insulation is provided between adjacent turns of the conductor. This reactor configuration provides an electrical path along the conductor between the first and second terminals having a current limiting reactance.

6 Claims, 2 Drawing Sheets

CURRENT LIMITING ELECTRICAL REACTOR

The present invention relates to a current limiting electrical reactor for use with short circuit current applications.

BACKGROUND OF THE INVENTION

It is well known to use current limiting electrical reactors to limit the flow of electrical current in a circuit under short circuit conditions, or under other operating conditions that draw large amounts of current.

One such application of a current limiting reactor, for example, is in the power supply used to regulate and control current supplied to an arc type furnace. In this application the power supply is a direct current power supply, such as a rectifier. The furnace has an electrode which contacts the furnace charge, metal for example, and melts the charge. In this application the electrode creates a short circuit condition when it contacts the charge which quickly raises the current drawn by the electrode. To limit current drawn, the current limiting reactor is placed in circuit between the furnace and the power supply. This placement of the reactor introduces reactance to the circuit which limits the rate of rise of current flowing to the electrode under short circuit conditions thereby allowing the power supply sufficient time to decrease the current flow to the electrode.

While the use of such reactors in power supplies for furnaces is known, the design of these reactors has been cumbersome and expensive. The state of the art reactor comprises a water cooled copper conductor of circular cross-section wound in a helical spiral. This reactor has a three-dimensional space requirement governed by the radius of the winding and the axial length of the winding. In practise these reactors may be as much as 4 feet in diameter and have an axial length of 4 feet or more. As a result of the winding configuration, floor space adjacent the power supply, or remotely in a separate room, is required for the reactor.

SUMMARY OF THE INVENTION

It is therefore an object of the present invention to provide a current limiting electrical reactor whose winding configuration results in a spacial savings when compared to the state of the art reactor mentioned herebefore.

It is another object of the present invention to provide a current limiting electrical reactor that is able to limit currents of several thousands of amperes and have reduced spacial requirements.

The current limiting electrical reactor of the present invention overcomes the spacial difficulties associated with the reactors mentioned above by constructing the reactor to have a supporting core with a circular periphery where the conductor is wound about the periphery of the coil in a convoluted spiral. It should be understood that by convoluted spiral it is meant a spiral where the conductor spirals laterally out from the periphery of the core, over itself and lies in a radial plane passing through the core. The configuration of the spiral resembles the shape of a cochlea.

Preferably, the conductor has a rectangular shape so that a cross-sectional area of the spiral at is rectangular and is occupied by the turns of the conductor. In the preferred embodiment, the width of the conductor is chosen to correspond substantially to the depth of the supporting core. The conductor is provided with a cooling passage continuously therethrough permitting fluid to pass through the conductor and cool same. Alternatively, the conductor could be air cooled.

Advantage is found with the reactor of the present invention in that its radial plane, which passes radially through the core and the convoluted spiral of the conductors, can be vertically oriented.

In accordance with one aspect of the present invention there is provided a current limiting electrical reactor comprising a supporting core having a circular periphery and an electrical conductor wound in a plurality of turns in a convoluted spiral about the periphery of the core with each succeeding turn of the conductor being closely adjacent to and overlapping the previous turn of the conductor. The reactor further includes a first and second terminal adapted for electrical connection. The first terminal is positioned at a beginning portion of the innermost turn of the conductor. The second terminal is positioned at an end portion of the outermost turn of the electrical conductor. The reactor includes insulation means for electrically insulating adjacent turns of the conductor from each other. The reactor provides an electrical path along the conductor between the first and second terminals which has a current limiting reactance.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE PREFERRED EMBODIMENT

Figure 1:
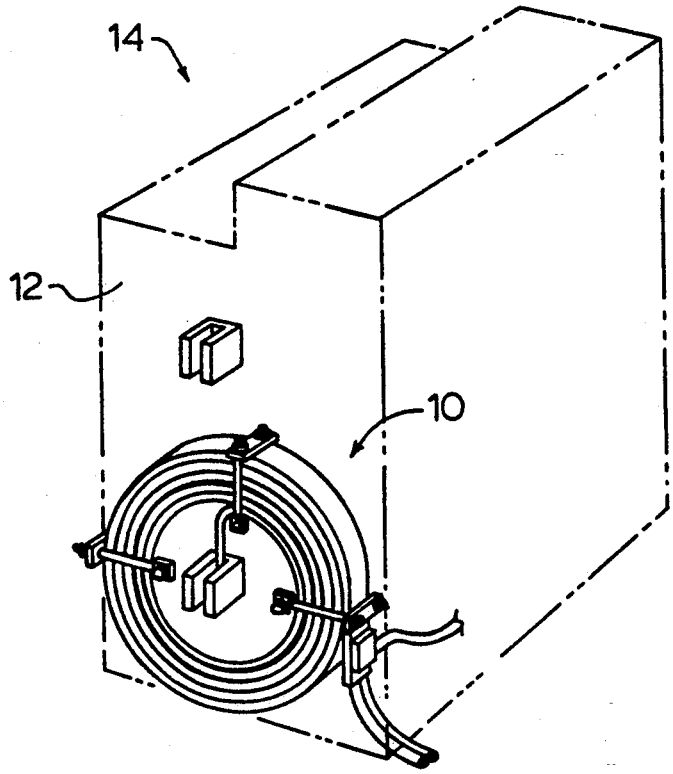
FIG. 1 is a schematic illustration showing the placement of the reactor of the present invention relative to a power supply.

Referring to FIG. 1 there is shown a schematic drawing of the reactor 10 of the present invention having its radial axis mounted in a vertical plane adjacent the wall 12 of power supply 14. In this preferred embodiment the power supply comprises a rectifier for converting alternating current power from a power line to direct current power. In practise the rectifier is contained within the housing shown. The housing is in the order of six feet wide, ten feet high and twelve feet deep. It should be understood that the reactor could be used with an alternating current power supply but in such an application the reactor 10 may have to be located further from the power supply or be shielded from the power supply due to the magnetic field effects associated with alternating current flowing through the reactor. In any event this drawing is useful for showing the advantage of the present invention vis a vis the orientation of the reactor beside the power supply which makes more efficient use of space.

Figure 2:
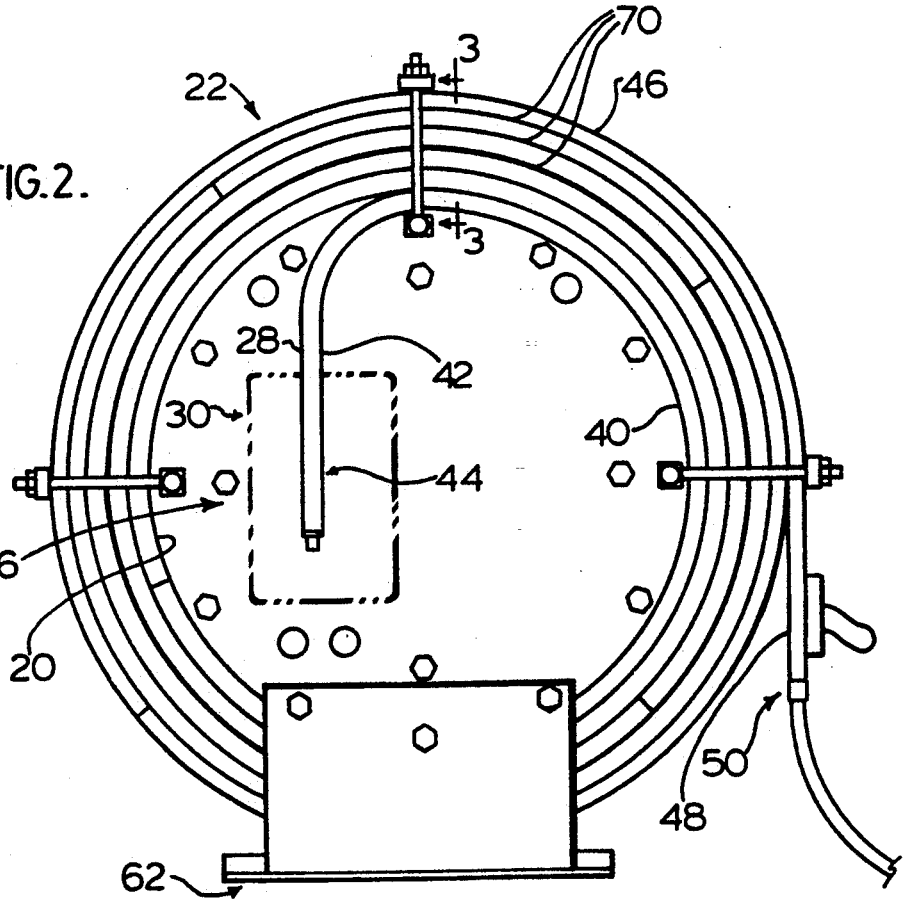
FIG. 2 is an detailed end view of the reactor positioned in an upright orientation.
Figure 5:
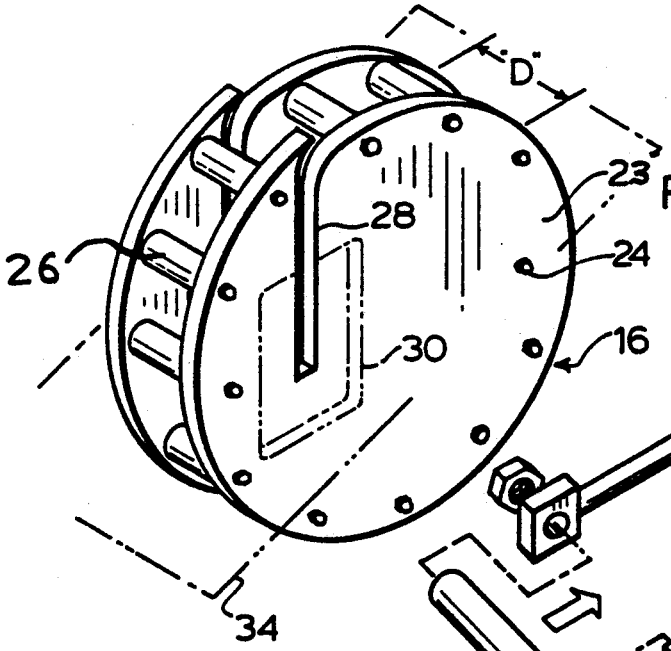
FIG. 5 is a perspective view of the core of the reactor.

Referring to FIGS. 2 and 5, the reactor has a core 16 having a center 18 and a circular peripheral 20 about which conductor 22 is wound. The core 16 comprises two spaced apart walls 23. Walls 23 are secured relative to each other by fastening means or stainless steel bolts and nuts 24, and spacers 26. Spacers 26 comprise sleeves throughwhich bolts 24 pass. In this preferred embodiment, spacers 26 and walls 23 of the core are made from fiberglass which is an electrical insulator. It should be understood that in an alternative embodiment, the core could be made of a conductive material, provided the core was insulated from the conductor 23. In the walls 22 of the core 16 there is cut an elongated slot 28 and opening 30. The slot 28 and opening 30 are used to facilitate electrical connection of one end of the conductor 22 to the terminals of the power supply 14.

Figure 3:
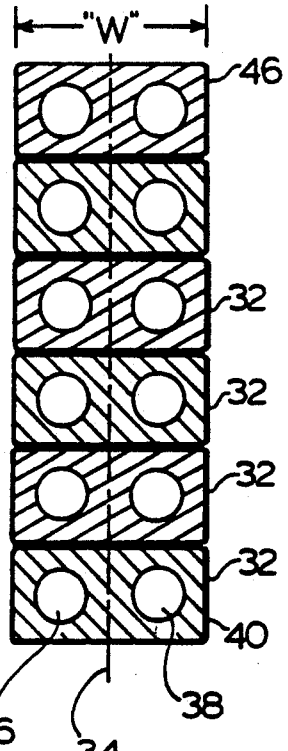
FIG. 3 is a section view of the turns of the conductor taken at section line 3—3 of FIG. 2.

In the preferred embodiment, the conductor 22 comprises rectangular shaped extruded copper that is wound about the core in an overlapping convoluted spiral as shown in FIG. 2. The winding of the copper about the core results in several turns 32 of conductor. It should be understood that the number of turns does not necessarily have to be an integer number but may be a fractional number of turns. Referring to FIG. 3, a cross-section of the each turn 32 of the conductor is shown. From FIG. 3 it is apparent that the conductor has a rectangular cross-section. The width "W" of the conductor corresponds to the width or depth "D" of the core 16 (see FIG. 5.). Consequently, the overlapping spiral of turns 32 of the conductor 22 extend laterally out from the periphery of the core 16 such that radial plane 34 passes through the center of the core 16 and the turns 32 of the conductor 22. Conductor 22 is provided with two water cooling passages 36 and 38 whereby water flows in opposite directions through the adjacent passages 36 and 38 to cool the conductor during operation. Alternatively, the conductor could be cooled by other means such as air, for example.

The innermost turn 40 of the turns 32 provides an end portion 42 that is bent into the slot 42 and has a terminal portion 44 located in opening 30. The size of opening 30 is larger to facilitate connection of the electrical terminal of the power supply 14 to terminal 44 of the conductor 22 and to facilitate connection of hoses to the coolant passages 36 and 38.

The outermost turn 46 of conductor 22 has an outer end portion 48 that terminates at terminal 50. Terminal 50 is adapted for electrical connection to a load. Also the terminal end 50 is adapted to for connection to hoses carrying coolant to passages 36 and 38.

Figure 4:
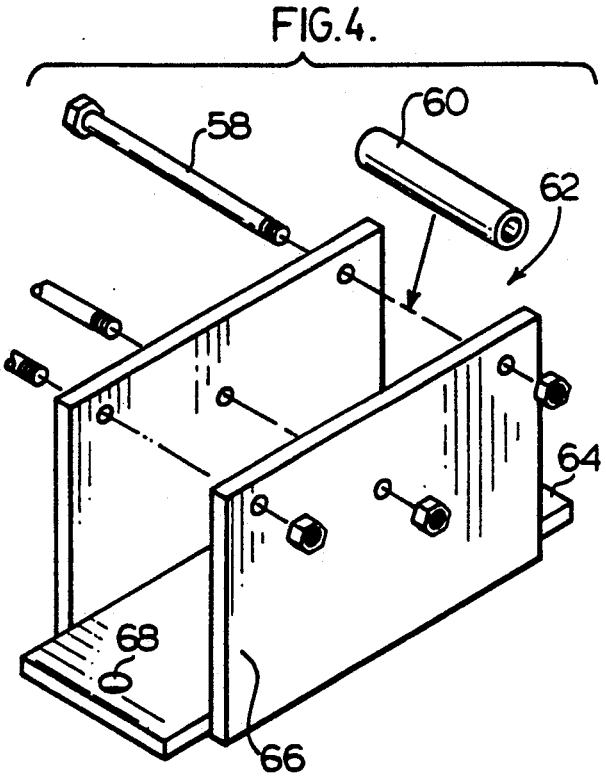
FIG. 4 is a schematic view of the stand used to orientate the reactor in an upright position.
Figure 6:
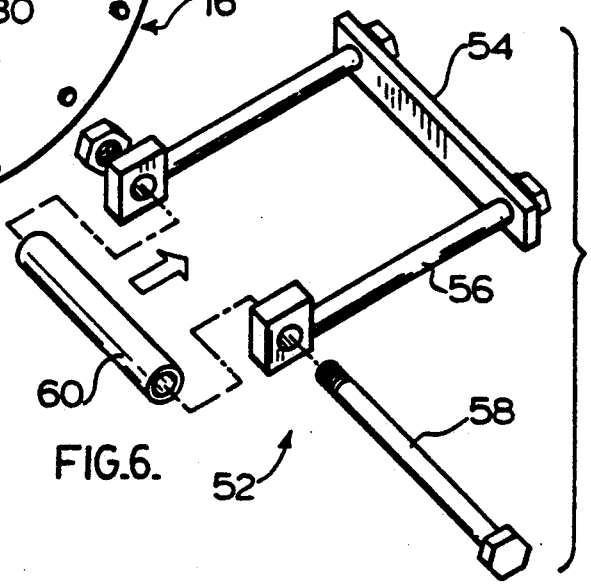
FIG. 6 illustrates the bracket members used to secure the conductor turns relative to the core.

Referring to FIGS. 4 and 6 there is shown the fastening structures used to secure the conductor 22 on the core 16 and to orientate the radial plane 34 of reactor 10 vertically. In FIG. 6, the brackets 52 would be spaced about the periphery of the reactor to hold the conductor 22 to the core 16. Each bracket assembly 52 is U-shaped having a fiberglass cross-member 54 adapted to engage the outer surface of the outermost turn 46 of conductor 22. Two stainless steel tie bolts having fiberglass sleeves 56 interconnect the cross-member 54 with the core 16 by means of securing bolt and nut 58 passing through drilled holes in the walls 23 of the core 16. An insulating fiberglass spacer 60 is located between the walls 23 of the core 16 over the stem of bolt 58.

Referring to FIG. 4, the stand 62 is shown to comprise a fiberglass floor plate 64 having two upstanding walls 66. The reactor 10 is placed on the stand 62 and securing bolts, nuts 58 secure the reactor 10 at its core 16 relative to the stand 62. Insulating spacers 60 are located within the walls 22 of the core 16 around the stems of bolts 58. Floor plate 64 has two apertures 68 for receiving floor mounting bolts.

Referring to FIG. 2, there is shown insulation 70 between adjacent turns 32 of the conductor 22. The insulation comprises a sheet of insulating paper or cloth that is placed between the turns during winding. Suitable insulation paper is would be made of NOMEX insulation, a trademark.

For the purpose of constructing the reactor of the present invention, it should be understood that sections of conductor may be bent about the core to provide the spiral where the adjacent ends of the conductor are joined by brazing. Further, the slot 28 and opening 30 of the core may be cut into the core 30 after the conductor 22 is wound onto the core so as to maintain the strength of the core during winding.

The reactor of the present invention provides a reactance to a current flow path along the conductor 22 between the first terminal 44 and the second terminal 50. The actual reactance of the reactor is a function of the cross-sectional area of the turns of the conductor, the mean radial distance of the conductor 22 from the center of the core, the cross-sectional shape of the conductor, and the number of turns of conductor 22 about the core 16. The reactor 10 of the present invention is suitable for use in a rectifier circuit used to control the operation of an electrode of an arc type furnace. This reactor would have an diameter in the order of four feet and a depth or axial width of four inches. The conductor 22 would have a width of about four inches and a thickness of about one and a quarter inches. The number of turns would be in the order of five and a quarter turns. A reactor having these dimensions would provide a reactance in the order of 50 microhenries and rated for currents as high as 42,000 amperes. Accordingly, the present invention is directed to a reactor capable of limiting currents of several thousands of amperes.

What I claim as new and desire to secure by Letters Patent of the Unites States of America is:

1. A current limiting electrical reactor comprising:

a supporting core having a circular periphery comprising a pair of spaced apart, circular sidewalls whose edges define the periphery of the core, the core further including insulated spacer means for securing the sidewalls in spaced apart relation, the sidewalls each having an inwardly directed opening and comprising an electrically insulating material, an electrical conductor wound in a plurality of turns in a convoluted spiral about the periphery of the core with each succeeding turn of the conductor being closely adjacent to and overlapping the previous turn of the conductor, a first terminal adapted for electrical connection and positioned at a beginning portion of the innermost turn of the conductor, the beginning of the innermost turn of the conductor having a leg portion bent and extending into the opening of the sidewalls to provide the first terminal;

a second terminal adapted for electrical connection and positioned at an end portion of the outermost turn of the electrical conductor; and, insulation means for electrically insulating adjacent turns of the conductor from each other, whereby an electrical path along the conductor between the first and second terminals has a current limiting reactance.

2. The reactor of claim 1 wherein the electrical conductor has a rectangular cross-section.

3. The reactor of claim 1 wherein the electrical conductor has a width substantially corresponding to the depth of the core.

4. The reactor of claim 1 further including stand means for mounting the reactor in an upright position such that a radial plane passing through the core and turns of the conductor is orientated vertically.

5. The reactor of claim 1 wherein the conductor has at least one cooling passage extending continuously therethrough through which fluid passes to cool the first conductor.

6. The reactor of claim 1 wherein the turns of conductor are secured to the periphery of the core by electrically insulated U-shaped bracket members passing about the turns of the conductor and having their leg portions secured to the core.

* * * * *